United States Patent [19]

Anderson

[11] Patent Number: 4,709,617

[45] Date of Patent: Dec. 1, 1987

[54] FIREARM

[76] Inventor: John A. Anderson, P.O. Box 5620, Hamden, Conn. 06518

[21] Appl. No.: 622,793

[22] Filed: Jun. 21, 1984

[51] Int. Cl.[4] ..... F41D 7/04

[52] U.S. Cl. ..... 89/157; 89/159

[58] Field of Search ..... 89/156, 157, 159, 161, 89/155, 1.4; 42/10, 11, 60, 59, 69.02, 69.03

[56] References Cited

U.S. PATENT DOCUMENTS

| | | | |
|---|---|---|---|
| 696,539 | 4/1902 | Bennett | 42/60 |
| 1,286,884 | 12/1918 | Revelli | 89/1.4 |
| 2,972,286 | 2/1961 | Marquardt | 89/155 |
| 3,051,057 | 8/1962 | Ivy | 89/156 |
| 3,507,186 | 4/1970 | Cermak et al. | 89/155 |
| 4,151,782 | 5/1979 | Allen | 89/161 |

FOREIGN PATENT DOCUMENTS

| | | |
|---|---|---|
| 805277 | 12/1958 | United Kingdom . |
| 1429568 | 3/1976 | United Kingdom . |

OTHER PUBLICATIONS

Hogg, The Complete Illustrated Encyclopedia of the World's Firearms, 1978, pp. 246–247, 258–259, 305, 317.

*Primary Examiner*—Stephen C. Bentley
*Assistant Examiner*—Stephen M. Johnson
*Attorney, Agent, or Firm*—McCormick, Paulding & Huber

[57] ABSTRACT

An automatic gas-operated forward recoiling combat shotgun has a reciprocally movable barrel which includes a bore and a revolving magazine which defines a circumaxially spaced series of firing chambers. In firing position, one of the firing chambers is coaxially aligned with and forms a rearward extension of the bore. A cam actuated indexing mechanism sequentially positions each of the firing chambers in firing position in response to reciprocal movement of the barrel. A manually reciprocally movable foregrip functions to cock the shotgun firing mechanism and also cooperates with the trigger mechanism to release the magazine when the forearm is operated while the trigger held in a firing position. A cocking trigger enables silent cocking or uncocking of the firing mechanism. The casing of each shell forms a seal between an associated firing chamber and the barrel when the weapon is fired.

24 Claims, 23 Drawing Figures

FIREARM

BACKGROUND OF THE INVENTION

This invention relates in general to firearms and deals more specifically with an improved combat shotgun particuarly adapted for use as a close assault weapon by military and law enforcement personnel.

The devastating effect of a shotgun at close range is well known and both military and law enforcement authorities have long recognized its value as a close assault weapon, because of its dispersed pattern fire and high hit capability at common combat ranges. Currently, there is no military shotgun system. The shotguns heretofore used by the military and by law enforcement agencies have been conversions or modifications of commercial manually operated pump shotguns and a wide variety of such shotguns are presently in use by the military. Such shotguns usually employ an injector bolt/extractor method of individual shell firing, lack semi-full automatic capability and have limited fire power. The actions of such shotguns are relatively complex, expensive to produce, prone to malfunction under adverse environmental conditions, and difficult to maintain in the field. Further, the relatively massive barrel and receiver requirements imposed by most conventional shotgun actions result in undesirable high heat retention characteristics. Such shotguns are difficult to operate and load in prone position, have high noise and flash signatures and generally lack the ruggedness required of a combat weapon.

Accordingly, it is the general aim of the present invention to provide an improved reliable semi-full automatic firearm of lightweight durable construction having a relatively simple action and adapted for ease of field maintenance in accordance with usual military requirements. It is a further aim of the present invention to provide an improved firearm which may be rapidly loaded and fired in any firing position, fired from one hand, if necessary, and immediately reloaded and fired after fully automatic fire. A still further aim of the invention is to provide an improved combat shotgun which permits quick barrel-change, allowing swift changeover to accommodate various ammunition.

SUMMARY OF THE INVENTION

In accordance with the present invention, a firearm is provided which comprises a barrel having a generally cylindrical bore, a rotary magazine having a circumaxial series of generally cylindrical firing chambers, and means supporting the magazine rearward of the barrel for indexible rotation about an axis generally parallel to the axis of the bore. One of the firing chambers in a firing position is coaxially aligned with the bore and defines a rearward extension of the bore. The firearm further includes means supporting the barrel for axial reciprocal movement generally toward and away from the magazine. A circumaxially spaced series of sets of cam surfaces on the magazine cooperate with a plurality of cams which move in response to movement of the barrel to index the rotary magazine and sequentially position and lock each of the firing chambers in firing position. One of the cams is engageable with one of the cam surfaces of an associated one of the sets of cam surfaces during movement of the barrel away from the magazine and another of the cams is engageable with another of the cam surfaces of the associated set during movement of the barrel toward the magazine.

DETAILED DESCRIPTION OF PREFERRED EMBODIMENT

Figures 1, 2:
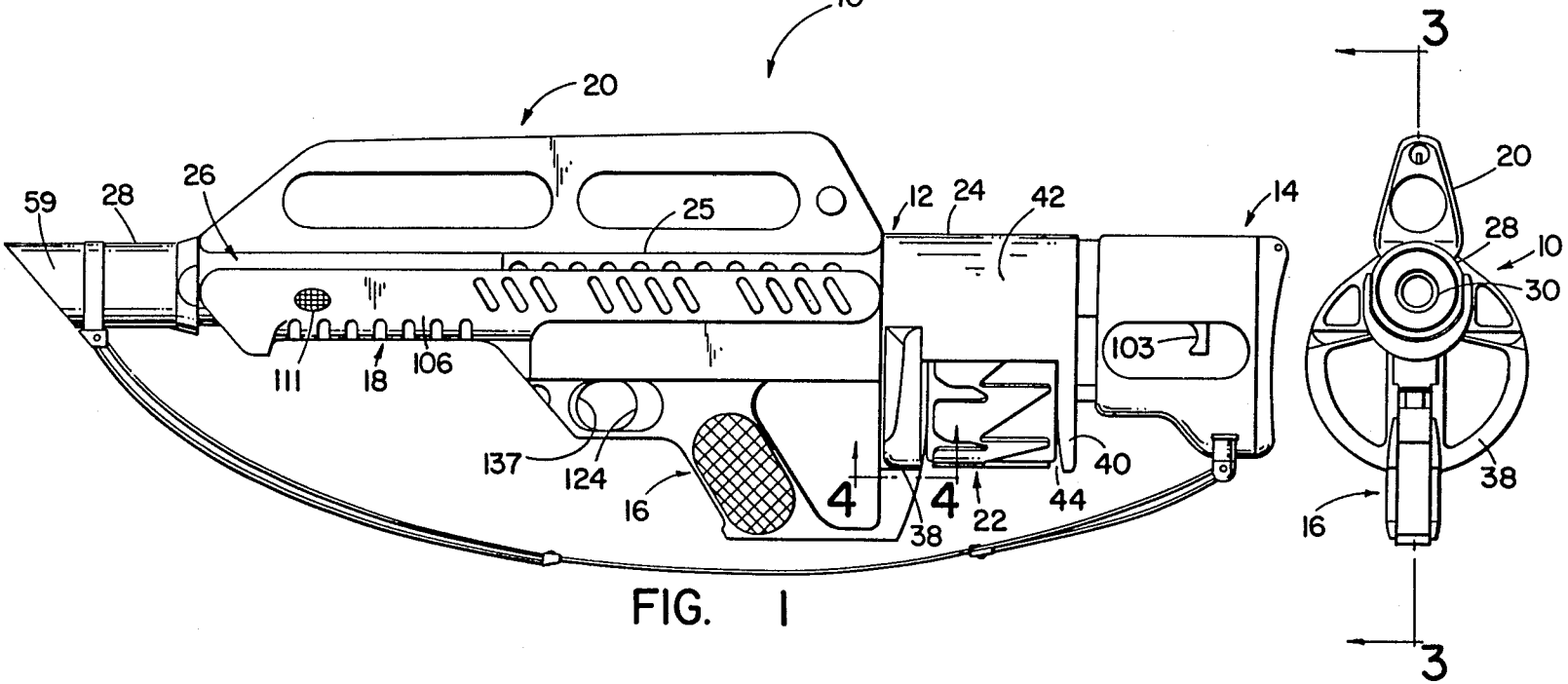
FIG. 1 is a side elevational view of a combat shotgun embodying the present invention.
FIG. 2 is a front elevational view of the shotgun of FIG. 1.

Turning now to the drawings, and referring first particularly to FIGS. 1–5, a firearm or combat shotgun embodying the present invention is designated generally by the reference numeral 10. The illustrated shotgun 10 is a gas operated fully automatic 10-round shotgun of bullpup type particularly adapted for use as a close assault weapon by military and paramilitary personnel and in maximum security situations. It essentially comprises a plurality of assembly groups which may be rapidly assembled or disassembled, in accordance with usual field stripping requirements for a military weapon, and includes a receiver assembly, indicated generally at 12, a butt stock assembly, designated generally by the numeral 14, and a trigger group assembly, indicated generally at 16. The assembly groups which comprise the shotgun 10 further include a front grip and gun activation assembly, a top bridge/fire control assembly, and a firing chamber cylinder or rotary magazine, respectively generally indicated at 18, 20 and 22, each of which will be hereinafter more fully described.

Figure 5:
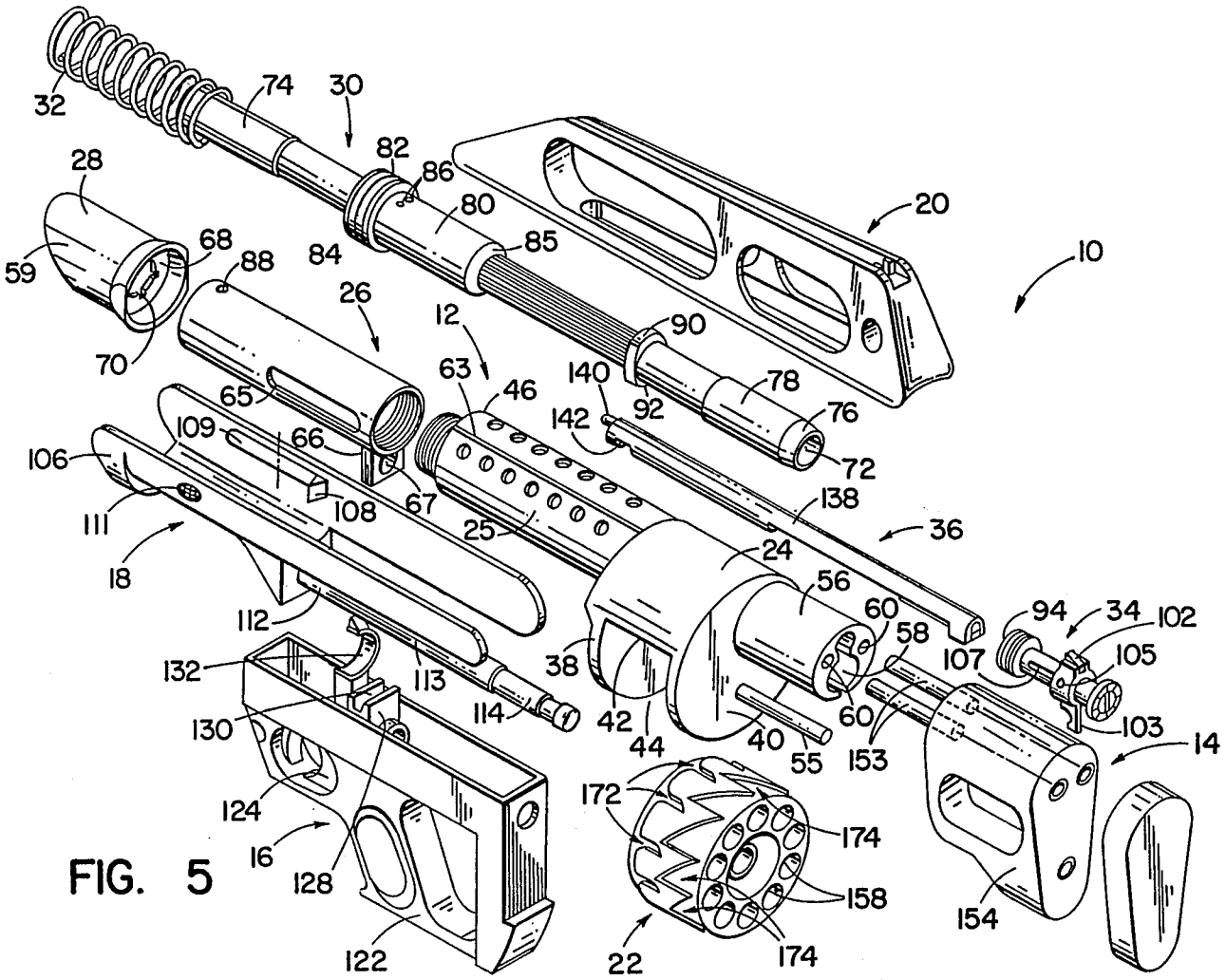
FIG. 5 is an exploded perspective view of the combat shotgun.

Considering now the shotgun 10 in further detail, and referring particularly to FIG. 5, the receiver assembly 12 includes a receiver 24 and a receiver extension 25. A gas cylinder connected to the forward end of the receiver is designated generally by the numeral 26. A recoil head assembly 28 is releasably secured to the forward end of the gas cylinder 26. The receiver, receiver extension, gas cylinder and recoil head assembly cooperate to house an axially elongated barrel indicated generally at 30 and supported for forward and rearward axial movement and an associated recoil spring 32 which exerts rearward directed biasing force on the barrel. A firing pin assembly, indicated generally at 34 and mounted within the receiver is operated by an elongated operating rod assembly, designated generally by the numeral 36, connected to and movable with the movable barrel 30.

Figure 4:
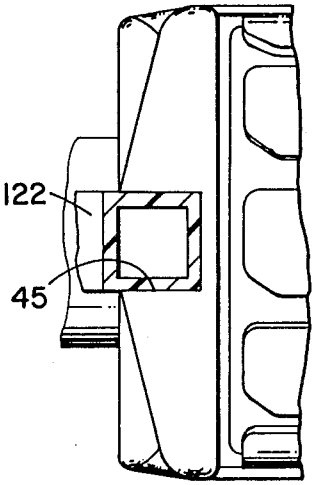
FIG. 4 is a somewhat enlarged fragmentary sectional view taken along the line 4—4 of FIG. 3.

The receiver 24 is preferably molded from durable high impact heat resistant plastic material and has a pair of generally circular magazine receiver front and rear walls 38 and 40 spaced apart in an axial direction and connected by an integral parti-cylindrical shroud wall 42. The front and rear walls 38 and 40 cooperate with the shroud wall 42 to define a downwardly opening magazine receiver 44, best shown in FIG. 5, for receiving and containing the rotary magazine 22. A forwardly and downwardly opening slot 45 is formed in the front wall 38, as best shown in FIG. 4. A cylindrical bore 46, best shown in FIG. 6, extends centrally through the front wall 38 in communication with the magazine receiver 44 and opens into the slot 45. A split snap ring 47 contained within the bore 46 is retained within an annular grove in the front wall 38, for a purpose to be hereinafter explained. A recoil retainer guide pin 55 secured to the rear wall 40 extends rearwardly therefrom and has a threaded opening in its rear end for receiving an associated fastener.

Figure 3:
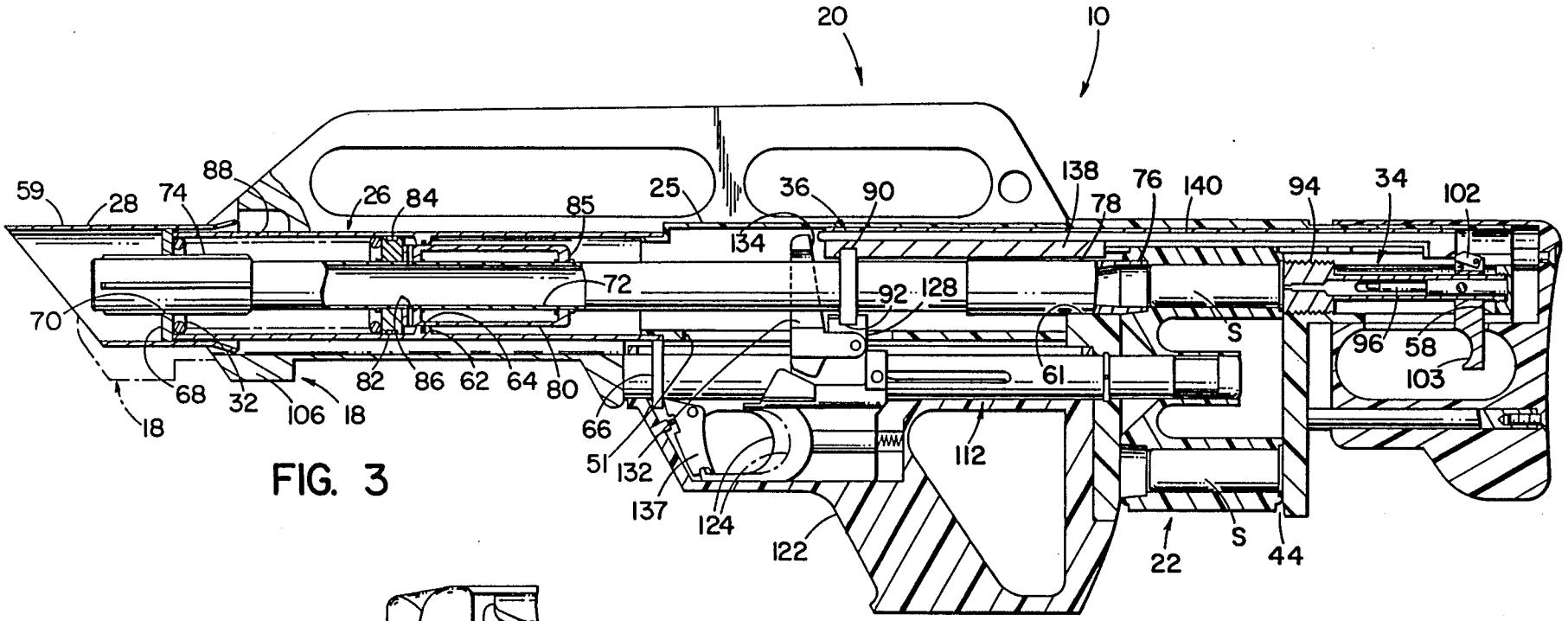
FIG. 3 is a sectional view taken along the line 3—3 of FIG. 2.

The receiver 24 also includes a generally cylindrical firing pin assembly housing portion 56 which projects in a rearward direction from the magazine receiver rear wall 40. A bore 58 having a generally figure 8-shaped cross-section extends through the housing portion 56 and communicates with the upper portion of the magazine receiver 44. The lower portion of the bore 58 is internally threaded at its forward end, as shown in FIG. 3. A pair of somewhat smaller rearwardly opening blind bores 60, 60 are formed in the firing pin assembly housing 56 at opposite sides of the bore 58, as shown in FIG. 5. for a purpose which will be hereinafter further evident.

The receiver extension 25 may, if desired, comprise an integral part of the receiver, but preferably it is formed as a separate part, for convenience in manufacture, and threadably connected to the forward end of the receiver. As shown, it is threaded at its forward end, perforated for barrel cooling, and has a generally cylindrical internal bearing surface 61 which opens into the upper part of the magazine receiver 44 in coaxial alignment with the lower portion of the bore 58. An axially extending slot 51 opens through the bottom of the receiver extension and parallel bridge mounting tracks open outwardly through the upper surface of the receiver extension. One of the tracks is shown in FIG. 5 and indicated at 63.

The gas cylinder 26 preferably comprises a generally cylindrical tubular member made from metal and internally threaded at its rear end for connection to the threaded forward end of the receiver extension 25. A pair of diametrically opposed slots 65, 65 (one shown in FIG. 5) located in the rear portion of the gas cylinder 26 open through opposite sides of the cylinder and extend in parallel relation to the cylinder axis. An annular compression ring 62 projects inwardly from the inner wall of the gas cylinder 26 and defines a generally cylindrical bearing surface 64, coaxially aligned with the bearing surface 61, as shown in FIG. 3. For a purpose which will be hereinafter explained, a gas vent or exhaust port 88 opens outwardly through the gas cylinder 26 forward of the compression ring 62 and communicates with the atmosphere. A lug 66 depends from the rear end portion of the gas cylinder 26 and defines a cylindrical bore 67 coaxially aligned with the bore 46.

The illustrated recoil head assembly 28 functions as a flash shield and is releasably connected to the forward end of the gas cylinder 26 by suitable quick disconnect fastening means, such as a bayonet slot/stud connection (not shown). It includes an outer cylindrical shell 59 and contains an annular spring retaining member 68 which defines a splined bearing surface 70 coaxially aligned with the bearing surfaces 61 and 64.

The movable barrel 30 is generally cylindrical, has a generally cylindrical bore 72 which extends coaxially through it and a diametrically enlarged portion of some axial extent at its forward end which defines an axially elongated splined bearing surface 74 received in one position of complementary sliding engagement within the splined bearing surface 70. At its rear end the barrel has a rearwardly converging tapered portion 76. A diametrically enlarged portion of some axial extent, immediately forward of the tapered portion 76, defines a cylindrical bearing surface 78 in complementary sliding engagement with the bearing surface 61.

The barrel 30 cooperates with the gas cylinder 26 to define a gas operating mechanism and has a diametrically enlarged portion of some axial extent intermediate its ends which defines a piston 80 slidably received within the bearing surface 64. A diametrically enlarged annular piston flange 82 projects outwardly from the forward end of the piston and defines another annular bearing surface 84 which slidably engages the inner surface of the gas cylinder 26. The rear end of the piston 80 defines a rearwardly facing annular bearing surface 85.

At least one gas port 86 formed in the barrel communicates with the bore 72 and opens outwardly through the piston 80 between the piston flange 82 and the compression ring 64, but preferably, a plurality of such gas ports are provided. The barrel also includes a pair of integral barrel lugs 90 and 92 which project above and below the barrel forward of the bearing surface 78. The recoil spring 32 surrounds a forward portion of the barrel and acts between the spring retainer 68 and the annular flange 82 to bias the movable barrel 30 in an axially rearward direction and toward the magazine receiver 44.

Figure 6:
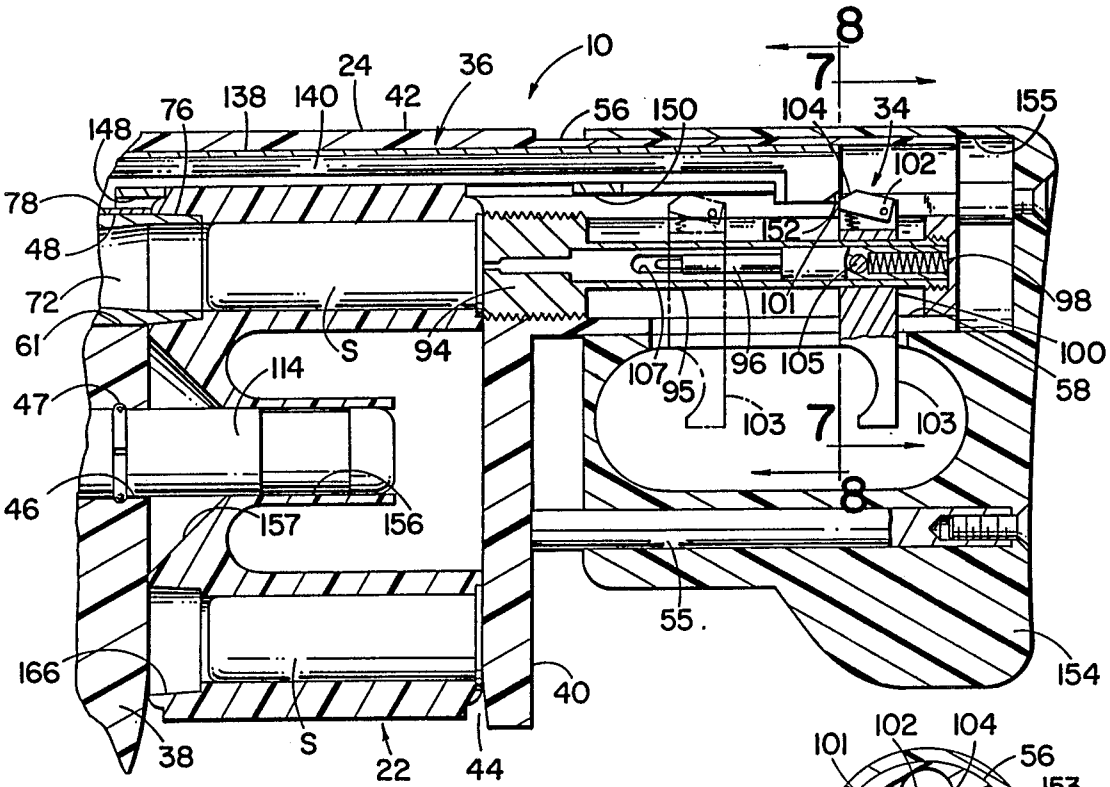
FIG. 6 is a somewhat enlarged fragmentary view of the shotgun as it appears in FIG. 3.
Figure 7:
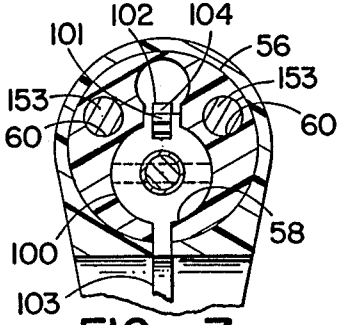
FIG. 7 is a fragmentary sectional view taken along the line 7—7 of FIG. 6.
Figure 8:
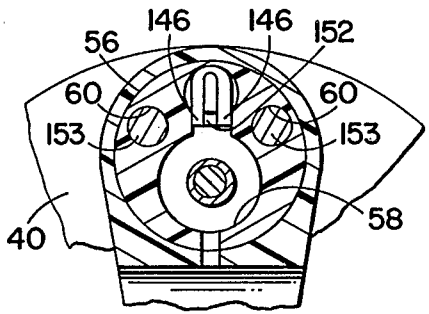
FIG. 8 is a fragmentary sectional view taken along the line 8—8 of FIG. 6.

Referring now particularly to FIGS. 6–8, the firing pin assembly 34, is disposed within the firing pin assembly housing 56 and includes a breech block 94 threadably engaged with the housing within the bore 58. A firing pin guide tube 95 extends rearwardly from the breech block and contains a firing member or firing pin 96 and a firing pin spring 98. A striker 100 slidably received on the guide tube 95 carries a pivoted sear indicated generally at 102 which has a forwardly facing abutment surface 101 and a forwardly facing upwardly and rearwardly inclined cam surface 104. The striker 100 has an integral depending auxiliary cocking trigger portion 103 and is attached to the firing pin by a yoke pin 105 which extends through the firing pin and the hammer and through slots 107, 107 (one shown) in opposite sides of the guide tube 95.

The front grip and gun activation assembly or grip assembly 18 provides means for cocking the firearm 10 and loading and unloading the magazine receiver 44. It also serves to retain the trigger group assembly 16 and guide the trigger, as will be hereinafter more fully explained, and includes a foregrip 106 preferably molded from durable heat-resistant plastic material. The foregrip is supported for forward and rearward movement below the gas cylinder 26 and carries a pair of opposing studs 108, 108, (FIG. 5) which project inwardly from opposite sides of the foregrip and through the slots 65, 65 in the gas cylinder 26 for engagement with diametrically opposite portions of the annular bearing surface 85 defined by the rear end of piston 80. Each stud 108 is mounted at the rear end of a lever 109 pivotally supported on an associated inner side of the foregrip 106 for pivotal movement about a vertical axis as generally shown in FIG. 5. The forward end of each lever 109 carries a release button 111 which projects outwardly through an aperture in an associated side the foregrip, as shown in FIGS. 1 and 5. The studs 108, 108 are biased toward and into the slots 65, 65, but may be released from the latter slots by simultaneously depressing the release buttons 111, 111 at opposite sides of the foregrip. The studs 108, 108 provide an operating connection between the manually movable foregrip 106 and the barrel 30 and cooperate with the slots 65, 65 to retain the foregrip and limit its forward movement relative to the gas cylinder 26.

Figure 9:
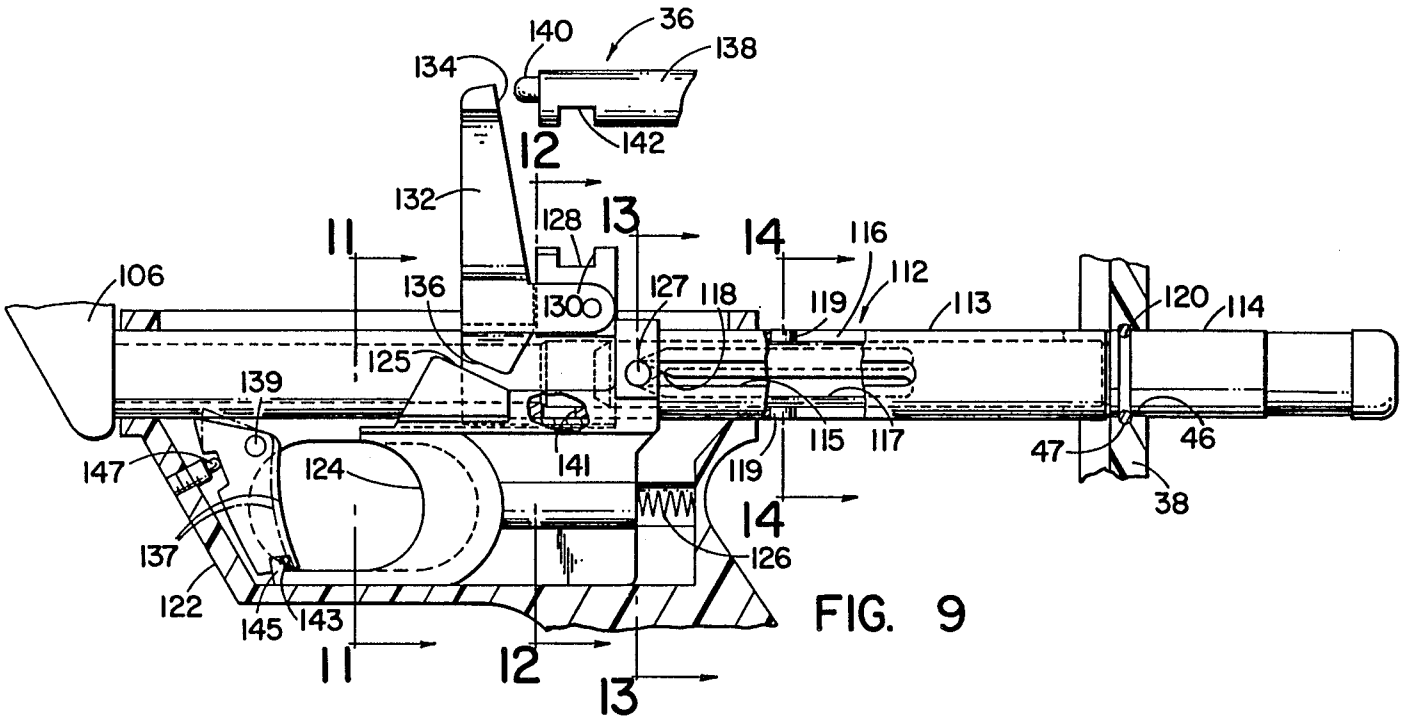
FIG. 9 is a somewhat enlarged fragmentary side elevational view of the shotgun as it appears in FIG. 3 showing portions of the guide tube and trigger group assemblies.
Figure 10:
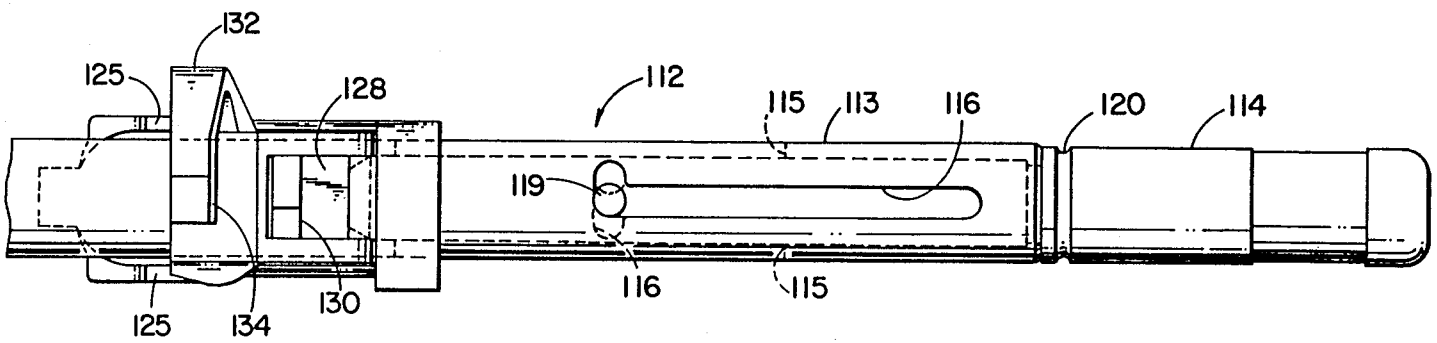
FIG. 10 is a fragmentary plan view of showing portions of the guide tube and trigger group assemblies shown in FIG. 9.
Figure 15:
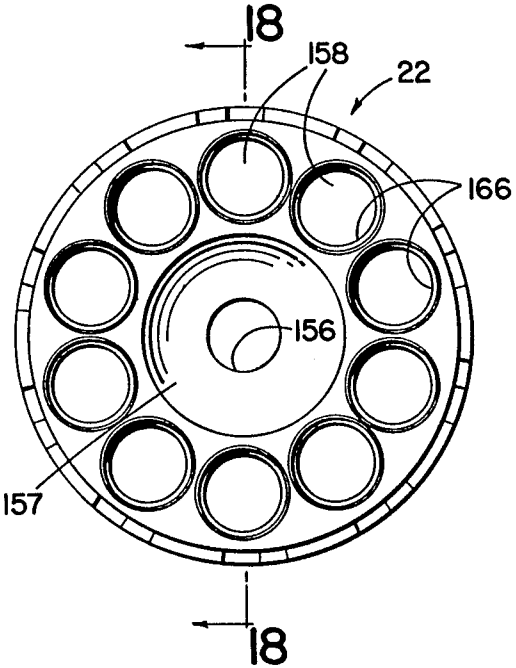
FIG. 15 is a somewhat enlarged front view of the magazine.
Figure 12:
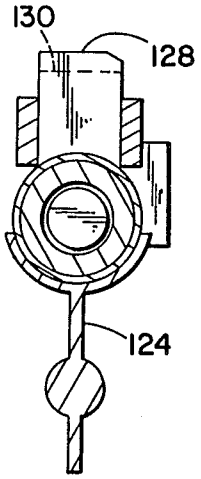
FIG. 12 is a fragmentary sectional view taken along the line 12—12 of FIG. 9.
Figure 14:
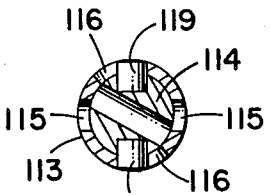
FIG. 14 is a fragmentary sectional view taken along the line 14—14 of FIG. 9.

The foregrip is further retained for forward and rearward movement relative to the gas cylinder by a rearwardly extending guide tube assembly, indicated generally at 112, mounted on a depending portion of the foregrip. The guide tube assembly, as best shown in FIGS. 9 and 10, is slidably received within the bores 67 and 46 and extends for some distance into the magazine receiver 44 to provide an axle for the rotary magazine 22. More specifically, the guide tube assembly 112 includes a magazine release tube 113 and a magazine axle rod 114. A front portion of the axel rod is telescopically slidably received within a rear portion of the release tube. A diametrically enlarged rear portion of the axle rod is slidably received in the bore 46 and projects into the magazine receiver to support the rotary magazine 22. In its rear portion the release tube 113 has a pair of axially extending slots 115, 115 which open through opposite sides of the tube. A pair of axially extending L-shaped bayonet slots 116, 116 of opposite hand open through the upper and lower sides of the release tube 113, substantially as shown in FIG. 10.

The front portion of the axle rod 114 has a generally axially extending slot 117 therethrough for general registry with the slots 115, 115 in the release tube. The slot 117 has a forward end portion 118 helically skewed relative to the axis of the tube assembly 112. Locking pins 119, 119 project from opposite sides of the axle rod into the bayonet slots 116, 116. An annular groove 120 is formed in the forward end of the diametrically enlarged rear portion of the axle rod to receive the snap ring 47, which functions as a detent to releasably retain the axle rod in its magazine supporting position within the magazine receiver 44.

Figure 11:
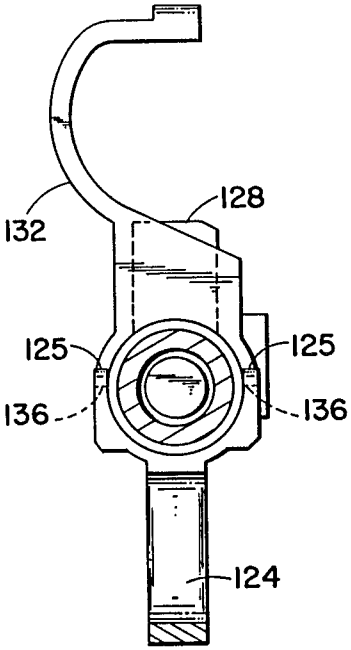
FIG. 11 is a fragmentary sectional view taken along the line 10—10 of FIG. 9.
Figure 13:
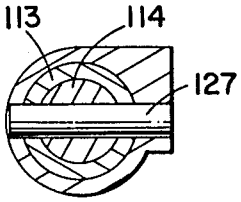
FIG. 13 is a fragmentary sectional view taken along the line 13—13 of FIG. 9.
Figure 17:
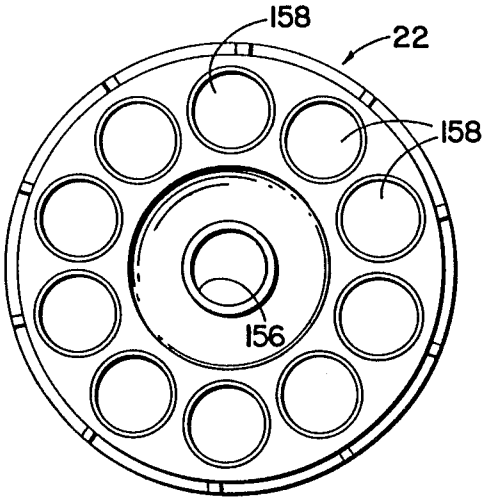
FIG. 17 is a somewhat enlarged rear view of the magazine.
Figure 18:
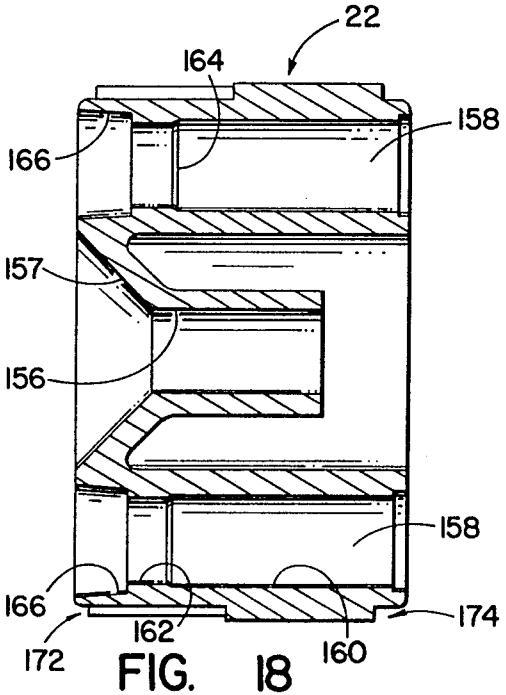
FIG. 18 is a somewhat further enlarged sectional view taken along the line 18—18 of FIG. 15.

Further, referring to FIGS. 3 and 4, the trigger group assembly 16 has a trigger frame 122, preferably molded from durable, high impact, heat resistant plastic material, which defines a pistol grip and a trigger guard. A vertically disposed rear portion of the frame 122 is received and retained within the slot 45. Apertures in the front and rear walls of the frame 122 above the pistol grip and trigger guard receive the guide tube assembly 112 therethrough. A trigger 124 is slidably supported on the tube assembly 112 and within a guide track in the trigger frame for rectilinear forward and rearward movement between inactive or full line position and a firing position indicated by broken lines in FIG. 3 and has upwardly facing cam surfaces 125, 125 disposed at diametrically opposite sides of the magazine release tube 113, as best shown in FIG. 11. The trigger carries a camming pin 127 which extends through the slots 115, 115, in the magazine release tube 113 and through the slot 117 in the axle rod 114 (FIGS. 9 and 10) and is biased in a forward direction and toward its inactive position by a trigger spring 126 which acts between the trigger and the frame 122, as shown in FIG. 3. The trigger group assembly further includes a firing element carrier 128 supported on the guide tube assembly 112 above the trigger for sliding movement therealong. An upwardly opening notch 130 in the upper end of the firing element carrier receives the lower barrel lug 92 to connect the carrier 128 to the barrel 30 for forward and rearward sliding movement along the guide tube assembly 112 in response to movement of the barrel.

The firing element carrier 128 provides pivotal support for a firing element or sear rod actuator 132 which projects upwardly through the slot 51 in the receiver extension and has a hook-shaped portion, which hooks around an associated portion of the barrel 30. The hook-shaped portion, best shown in FIG. 11, is sized to allow the rear part of the barrel to be inserted through it and to permit the sear rod actuator 132 to pivot freely on the carrier 128 and relative to the barrel. A rearwardly facing cam surface 134 is formed on the upper portion of the sear rod actuator above the barrel, as shown in FIG. 3. The lower portion of the sear rod actuator 132 straddles the magazine release tube and defines downwardly facing cam surfaces 136, 136 which cooperates in camming engagement with the cam surfaces 125, 125 on the trigger.

In accordance with the invention, means is provided for locking the foregrip 106 in its forward position against the action of the recoil spring 32. For this purpose the trigger group assembly includes a locking trigger 137, best shown in FIG. 9. The locking trigger is pivotally supported on the trigger frame 122 by a pivot pin 139 for movement between a released or full line position and a locked or broken line position and is movable to locked position in response to slight forwardly directed pressure when the foregrip 106 is in its forward position. In the locking position an upper end portion of the locking trigger 137 is disposed within a locking slot 141 in the lower side of the magazine release tube 113. A downwardly opening slot 143 in the lower end of the locking trigger receives an upwardly projecting finger 145 mounted at the forward end of the trigger 124. The locking trigger 137 is retained in its unlocked position by a frictional detent 147 mounted in the trigger frame, substantially as shown. Preferably, the trigger group assembly also incudes a manually operable safety mechanism for blocking the trigger in its inactive or safe position. However, the presently preferred safety mechanism is of conventional type and is not shown.

The operating rod assembly 36 functions to cock the firing pin assembly, provides operable connection between the trigger group assembly and the firing pin assembly and also serves to index the magazine to and lock it in firing position. It is supported in the upper part of the receiver 24 and comprises an elongated tubular operating rod 138, for cocking the firearm 10 and indexing and locking the magazine 22. A sear releasing rod 140 extends through and is supported for coaxial sliding movement by the operating rod 138. The operating rod has a downwardly opening notch 142 at its forward end which receives the upper barrel lug 90. The latter lug connects the operating rod to the barrel to move with it. The operating rod extends rearwardly through the upper portion of the magazine receiver 44 and into the upper portion of the bore 58. Rearwardly facing shoulders 146, 146, are defined by the rear surface of the operating rod, as best shown in FIG. 8. Spaced apart downwardly facing front and rear indexing and locking cams 148 and 150 on the lower surface of the operating rod cooperate with the magazine 22 within the magazine receiver in a manner hereinafter further discussed.

The sear releasing rod 140 has a nose at its forward end which projects beyond the forward end of the operating rod 138 and into the path of the cam surface 134 on the upper end of the sear rod actuator. An upwardly and rearwardly inclined cam surface 152 is defined by the rear end portion of the sear releasing rod for engagement with the cam surface 104 on the sear.

The butt stock assembly 14 generally comprises a stock 154 molded from durable heat resistant plastic material which forms the stock of the shotgun 10. A forwardly opening bore 155 formed in the stock receives the firing pin housing 56. A pair of forwardly projecting recoil retainer guide pins 153, 153 (FIG. 5) which comprise part of a recoil system (not shown) are secured by suitable fasteners to the stock within the bore 155 and extend into the bores 60, 60. Another forwardly opening bore formed in the stock 154 receives the recoil retainer guide pin 55. A single fastener threadably engaged within the threaded opening in the rear end of the pin 55 secures the butt stock assembly to the receiver. A suitable shoulder pad may be provided, as desired.

The top bridge/fire control assembly 20 is releasably secured to the receiver extension by the tracks 63, 63 and a suitable detent mechanism (not shown). It carries the gun sights, serves as a carrying handle, and also provides mounting means for auxiliary sighting accessories.

Considering now the magazine and referring particularly to FIGS. 15–19, the illustrated magazine 22 is preferably molded from durable high impact heat resistant plastic material and has a generally cylindrical drum-shaped configuration and a coaxial central bore 156 sized to receive the rear portion of the axel rod 114. A forwardly diverging conical lead surface 157 formed in the magazine and surrounding the forward end of the bore 156 aids in loading the magazine in the magazine receiver 44. The magazine has a circumaxial series of generally cylindrical firing chambers 158, 158 for receiving and containing shotgun shells, such as the shell S shown in FIGS. 3, 6 and 20. The number of firing chambers provided may vary. However, the illustrated magazine 22 has 10 firing chambers. The axial length of the magazine is somewhat greater than the axial length of the largest unexploded shotgun shell S to be contained within it.

Figure 16:
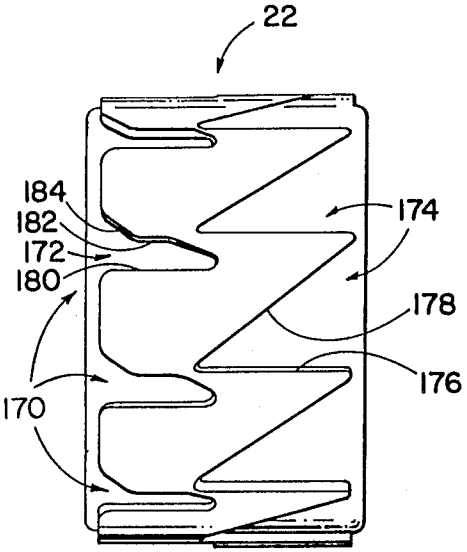
FIG. 16 is a somewhat enlarged side elevational view of the magazine.

The firing chambers are preferably formed to compensate for slight variations in dimensional tolerances between the shells of different manufacturers. A typical firing chamber 158 shown in FIG. 20, includes a main portion 160. Another cylindrical portion 162, forward of the main portion, has a diameter slightly smaller than the diameter of the main portion 160. A generally conical transitional portion 164 converges from the main portion 160 to the other portion 162, substantially as shown. The rear end portion of the chamber is slightly diametrically enlarged to receive a flange on the shell base. The shell S has a resilient casing the outside diameter of which is substantially equal to the diameter of the main portion 160. The forward end portion of the casing is received in press fit engagement within the bore portion 162. A diametrically enlarged conically tapered and forwardly diverging barrel receiving chamber 166 is formed in the magazine forward of each firing chamber for receiving and complementing the barrel rear end portion 76. In FIGS. 3, 6 and 16, the shotgun 10 is shown in firing position. It should be noted that the barrel rear end portion 76 is disposed within an associated barrel receiving chamber 166 so that the firing chamber 158 forms a rearward extension of the bore 72.

Figure 20:
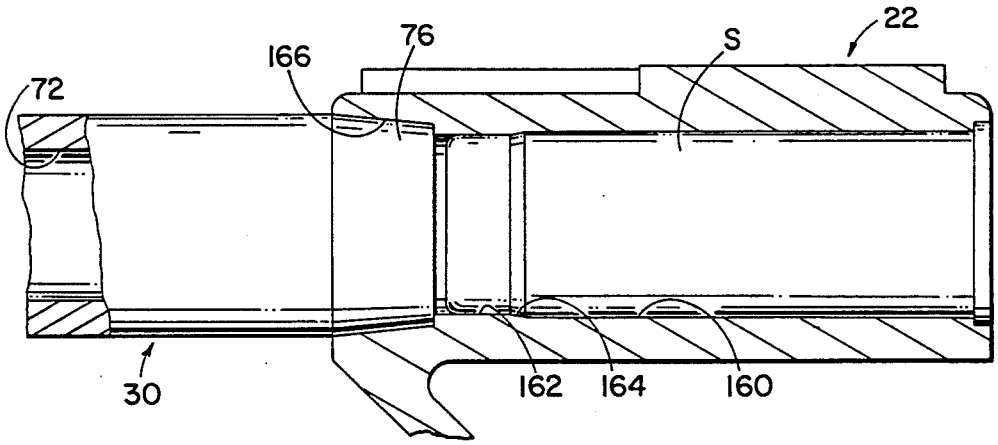
FIG. 20 is a somewhat enlarged fragmentary axial sectional view through the magazine shown with an unexploded shell in one of the chambers at the firing position.

The magazine 22 is indexible moveable about its central axis of rotation, defined by the axis of guide tube assembly 112, to sequentially position each firing chamber 158 in a firing position, shown in FIGS. 3, 6 and 20, and has a plurality of sets of cam tracks or cam surfaces indicated generally at 170, 170, equal in number to the firing chambers in the magazine. The cam surfaces which comprise the various sets cooperate in camming relation with the front and rear indexing cams 148 and 150, on operating rod. In the illustrated magazine, the cam surfaces are defined by the walls of cam recesses formed in the peripheral surface of the magazine.

Figure 19:
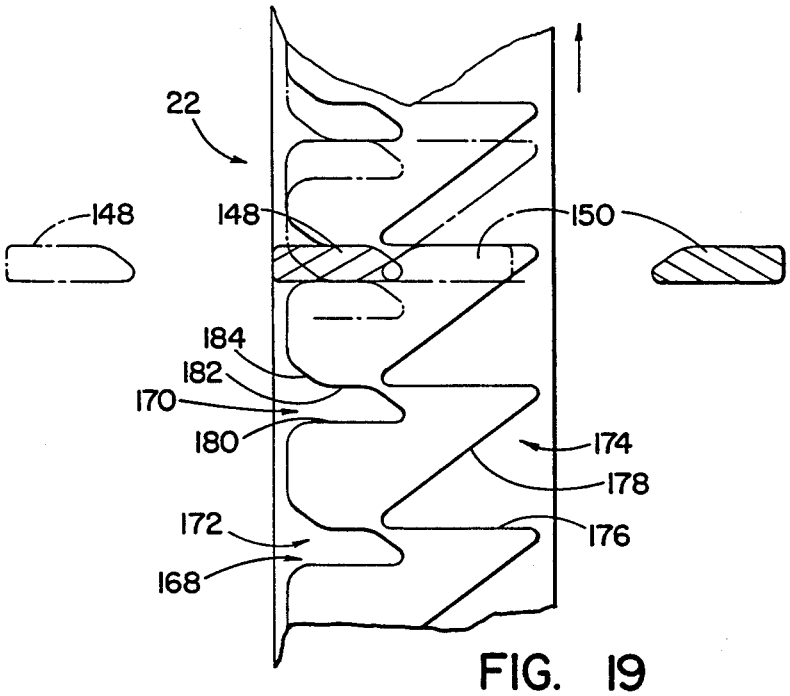
FIG. 19 is a fragmentary development of a portion of the peripheral surface of the magazine showing the sets of cam surfaces formed thereon.

Referring now to FIG. 19, a development of a portion of the magazine peripheral surface is shown. Each set of cam surfaces includes a front cam recess indicated generally at 172 for cooperating with the front indexing cam 148 and a rear cam recess designated generally by the numeral 174 for cooperating with the rear indexing cam 150.

The illustrated magazine 22 is arranged for indexible rotation in clockwise direction, as viewed from the rear, and has 10 sets of cam surfaces. Each set of cam surfaces cooperates with the front and rear indexing cams 148 and 150 during one operational cycle of the gun to effect 36 degree angular rotation of the magazine, during which one firing chamber, containing a spent shell, moves out of firing position and the next succeeding firing chamber, containing a loaded shell, indexes into and is locked in firing position.

Further referring to FIG. 19, each front recess 172 opens radially outwardly and through the front surface of the magazine and each a rear recess 174 opens radially outwardly and through the rear surface of the magazine 22. The cam surface defined by the rear recess 174 has a first portion 176, which extends inwardly from the rear end of the recess 174 in generally parallel relation to the axis of the magazine, and a second portion 178, which extends outwardly from the front end of the recess 174 and away from the first portion 176 in the direction of indexible rotation indicated by the directional arrow in FIG. 19. The front cam surface in the corresponding set 170 has a third portion 180 which extends inwardly from the front end of the recess 172 in generally parallel relation to the axis of the magazine. A fourth portion 182, parallel to the third portion 180 and angularly spaced therefrom in the direction of indexible rotation, and a fifth portion 184 which extends forwardly from the forward end of the fourth portion 182 and away from the fourth portion in the direction of indexible rotation, and terminates at the forward end of the front cam recess 172.

The firearm 10 may be cocked to move the striker from its broken line to its full line or cocked position of FIG. 6 by pumping the foregrip 106 forward and then rearward. Forward movement of the foregrip causes the lugs 108, 108 to cooperate in engagement with the rearwardly facing bearing surface 85 on the piston to move the barrel in an axially forward direction against the biasing force of the recoil spring 32. The operating rod assembly 36 connected to the barrel moves forward with it. When the rear end of the operating rod clears the sear, the sear is biased in clockwise direction (FIG. 3) to a position of engaging alignment behind the operating rod. Upon return movement of the foregrip 106, the surface 146, 146 at the rear of the operating rod engage the sear surface 101 to carry the firing pin assembly 34 to its cocked or full line position of FIG. 6 in which position it is retained by the operating rod.

When the foregrip is pumped the magazine release tube 113 slides freely relative to the magazine axel rod 114, which is retained in its magazine supporting position by the snap ring 47. Pumping the foregrip also serves to index the magazine, moving one firing chamber out of firing position and bringing the next successive firing chamber into firing position. This indexing cycle is hereinafter more fully described.

The weapon may also be silently cocked by drawing back the cocking trigger 103 from its broken line to its full line position of FIG. 6, to position the sear 102 rearward of and in engagement with the operating rod 138.

In FIG. 3, the loaded shotgun 10 is shown in cocked condition. The sear 102 is engaged with the rear end of the operating rod and holds the striker and the firing pin 96 connected thereto in cocked position against the biasing force of the compressed firing pin spring 98. In the presently preferred embodiment 10, the trigger 124 is arranged to move 500 thousandths inches between its inactive or full line and its active or firing position shown in broken lines in FIG. 3. It should be noted that there is substantial clearance between the nose of the sear actuator rod and the cam surface 134 on the sear rod actuator 132 and between the cam surface 152 on the rear of the sear actuator rod and the associated cam surface 104 on the sear when the firearm 10 is cocked. These clearances are taken up during the first 250 thousandths inch rearward movement of the trigger toward its firing position. Further rearward movement of the trigger from its 250 thousandths position is required to fire the weapon. In the presently preferred embodiment of the invention, sear release begins at 0.375 to 0.475 thousandths inch rearward trigger movement to effect firing of the weapon, the remainder of the 500 thousandths inch rearward trigger movement being overtravel.

When the trigger 124 is in its inactive position, the camming pin 127 carried by the trigger is disposed at the forward end of the slots 115, 115 and in the forward or helically skewed portion 118 of the slot 117. Initial rearward movement of the trigger causes rearward movement of the camming pin 127 within the slots 115, 115 and within helically skewed slot portion 118 which causes clockwise rotation of the magazine axle rod 114, as viewed from the rear of the gun, within and relative to the release tube 113 to bring the extending locking pins 119, 119 into locking engagement within the forward ends of the bayonet slots 116, 116. This locking action occurs within the first 250 thousandth inch rearward movement of the trigger. Further, rearward movement of the trigger causes the coengaging cam surfaces 125, 125 and 136, 136 on the trigger and on the sear actuator lever to pivot the sear actuator lever a sufficient distance to cause sufficient rearward movement of the sear actuating rod to bring the cam surfaces 152 and 104 into coengagement to release the sear.

Figure 21:
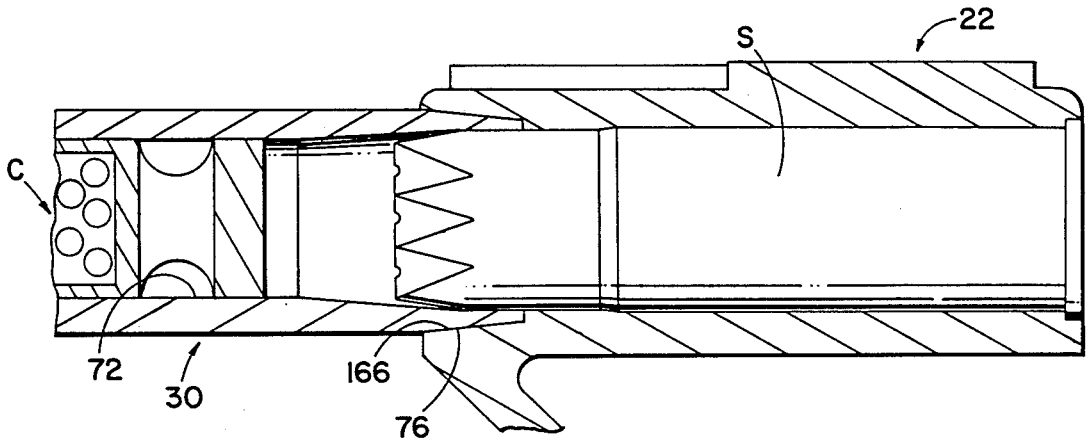
FIG. 21 is similar to FIG. 20 but shows the exploded shell an instant after the shotgun has been fired.

Upon release of the sear the firing pin 96, urged by the firing pin spring 98, strikes the primer of a shell S in firing position, detonating the primer and the explosive charge within the shell. Upon detonation, the crimped forward end portion of the shell casing, which provides a closure for the forward end of the unexploded shell, opens and extends from the firing chamber 158, into the barrel bore 72, as shown in FIG. 21, forming a generally cylindrical gas seal between the forward end of the firing chamber and the rear end of the barrel bore 72 to prevent the escape of gases of explosion at the region between the barrel 30 and the magazine 22. As the shot charge and carrier, indicated generally at C in FIG. 21, propelled by the gases of explosion, pass the gas ports 86, 86, gas under pressure escapes from the bore through the latter ports into the gas chamber and more specifically into the space between the piston flange 82 on the movable barrel and the stationary compression ring 62 on the gas cylinder 26. Pressure exerted by gases of explosion acting upon the piston flange 82 causes the barrel 30 to recoil in forward direction against the biasing force of the recoil spring 32.

As the forwardly moving barrel slides within the bearing surfaces 48, 64 and 70, the operating rod moves with it to move the front indexing cam 148 forward within an associated front cam recess 172. During initial forward movement of the barrel, the front indexing cam 148 is disposed between the parallel third and fourth cam surface portions 180 and 182 causing the magazine 22 to dwell at a fixed angular position relative to the barrel. After the barrel rear end portion 76 clears the front wall of the magazine, the rear indexing cam 150 engages the inclined cam surface portion 178. Further forward movement of the barrel 30 angularly advances the magazine 22 in a clockwise direction, as viewed from the rear. As the piston flange 82 passes the exhaust port 88, gas is vented to atmosphere and gas pressure within the gas cylinder 26 abruptly decreases allowing the recoil spring 32 to reverse the direction of barrel movement.

During initial rearward barrel movement, the front indexing cam 148 engages the cam surface portion 184 to further angularly advance the magazine 22. As the rear end portion of the barrel approaches the front wall of the magazine, the magazine attains a firing position wherein the next successive loaded firing chamber 158 is in coaxially aligned with the barrel. During the final portion of rearward barrel travel the magazine dwells in coaxial alignment with the barrel and the tapered rear end portion 76 enters and seat within an associated complementary barrel receiving portion 166 accurately aligning an associated firing chamber with the bore 72.

Return rearward movement of the barrel 30 causes corresponding rearward movement of the operating rod assembly 36. The rear end portion of the operating rod, disposed forward of the sear 102, which is biased upwardly, engages the sear and moves the striker 100 to its cocked position. If the trigger 24 is held in its firing position, the coengageing cam surfaces on the trigger and on the sear rod actuator lever cooperate to hold the sear rod actuator lever in its firing position as the barrel reaches the end of its rearward travel. This, in turn, causes the sear releasing rod 140 to release the sear 102 and fire the next successive shell S which has been indexed to and locked in a firing position. The gun will continue to fire automatically until the trigger is released or the magazine is empty.

If semi-automatic fire is desired, the trigger 124 is promptly released after a shell has been fired. When the trigger is in its inactive or full line position of FIG. 3, the cams 125, 125 are in forward position. The cam 134 associated with the sear rod actuator lever, which is moving with the barrel, will move into and out of camming engagement with the nose of the sear releasing rod before the striker 100, urged rearwardly by the moving operating assembly 36, reaches its cocked position. However, the sear 102 is constructed and arranged so that it will not release from engagement with the operating rod assembly 36 during rearward travel of the operating rod assembly. More specifically, means (not shown) is provided to prevent premature release of the sear 102 by the sear releasing rod 140 during rearward movement of the operating rod assembly 36, so that the sear cannot be released to release the striker 100 until the striker is in its fully cocked position.

In the event of a malfunction, the weapon may be promptly cleared by pumping the foregrip 106 while the trigger is in its inactive position to index the magazine 22.

Reloading is accomplished by moving the foregrip 106 to its forwardmost position while the trigger 124 is simultaneously held in a partially drawn back position. As previously discussed, the first 250 thousandths inch trigger movement effects locking of the magazine axle rod 114 to the magazine release tube 113. Consequently, forward movement of the foregrip 106 while the trigger is in a partially drawn back position will cause the magazine axle rod 114 to be withdrawn from the magazine receiver and the magazine bore 156, allowing the magazine 22 to drop out of the receiver. While the foregrip 106 is in its forward position the locking trigger 137 is moved to locking position by slight forward pressure of the trigger finger. While the foregrip is in its forward or locked position, a loaded magazine is inserted into the magazine receiver. Thereafter, slight rearward movement of the trigger 124 releases the locking trigger from its locking position allowing the foregrip to return the magazine axel rod to its magazine supporting position in response to the biasing force of the recoil spring 32. The conical lead surface 157, which surrounds the forward end of the magazine bore 156, aids in rapidly loading the magazine.

To uncock the shotgun the cocking trigger is first held in its rearmost position to maintain the firing pin spring in its compressed condition. Thereafter, the trigger 124 is drawn back to its firing position to release the sear 102 from engagement with the operating rod assembly 32. While the sear is held in its released position by the trigger 124, the cocking trigger 103 is eased in a forward direction to gradually release the potential energy stored in the firing pin spring 98.

If it should be necessary to remove a loaded magazine from the receiver, it is preferable to first uncock the weapon in the aforedescribed manner. However, the loaded magazine may be released from the receiver while the weapon is in cocked position by moving the foregrip 106 forward while the trigger 124 is held in a partially drawn back position, as hereinbefore discussed.

The barrel may be readily removed for replacement by another barrel to fire ammunition of a different caliber and/or purpose by simply removing the recoil assembly 28 which also causes the barrel to rotate to disengage the barrel lugs 90 and 92, after which the barrel may be withdrawn. After the barrel has been changed, a corresponding loaded magazine is secured in the magazine receiver and the gun is ready to be fired.

Figure 23:
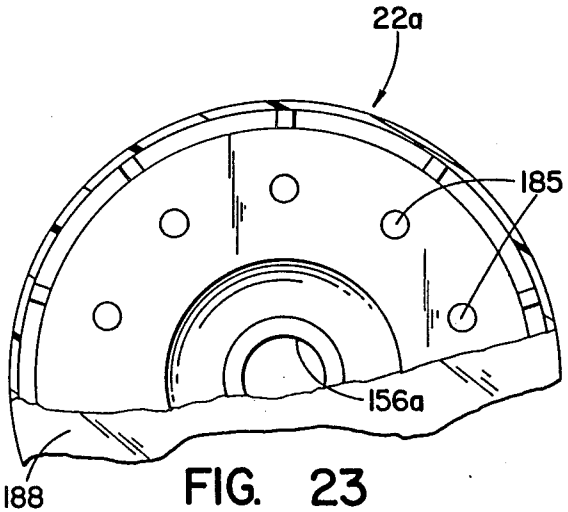
FIG. 23 is a fragmentary rear elevational view of the magazine of FIG. 22.
Figure 22:
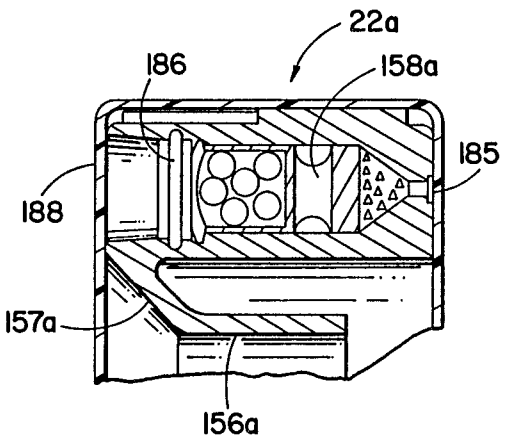
FIG. 22 is a fragmentary axial sectional view through another magazine assembly embodying the invention.

Referring now to FIGS. 22 and 23, another magazine embodying the invention includes self contained preloaded firing chambers, i.e., caseless ammunition, is illustrated and described. The magazine indicated generally at **22*a* is similar in many respects to the magazine 22 previously described, however, it differs from the magazine 22 in that it includes a plurality of caseless rounds. More specifically, an explosive charge, a carrier and one or more projectiles, such as shot, are loaded directly into each firing chamber 158*a* and sealed therein, substantially as shown. The magazine 22*a* defines a rear wall of each chamber 158*a*. A primer 185 is supported in the rear wall of each chamber, substantially as shown. The front wall of each chamber is defined by a suitable insert 186**, which may, for example, be provided with radially extending lines of weakening so that it ruptures in a predetermined manner to form a generally cylindrical seal between the chamber and the barrel bore, as hereinbefore described, when the associated explosive charge is exploded.

The illustrated magazine assembly **22*a* is sealed within a plastic envelope 188** which protects the magazine and its associated explosive charges against all types of contamination. A suitable tear strip (not shown) may be provided to facilitate rapid removal of the magazine from its plastic envelope, as required.

I claim:

1. A firearm comprising a receiver, a barrel supported by said receiver and having a generally cylindrical bore, a rotary magazine having a circumaxial series of firing chambers, magazine retaining means for releasably securing said magazine to said receiver for rotation about its axis of rotation and including a first member coaxially disposed within said magazine, means for indexing said magazxine about its axis of rotation to sequentially locate each one of said firing chambers in a firing position wherein said one firing chamber is coaxially aligned with said bore, firing means for exploding a shell disposed within said one firing chamber and having a cocked position and a firing position, a firing trigger movable from an inactive position to a firing position to release said firing means from its cocked position, manually inoperable means for cocking said firing means including a grip assembly supported for reciprocal movement relative to the receiver and including a second member telescopically engaged with said first member, and coupling means for releasably connecting said second member to said first member in response to movement of said firing trigger to a predetermined position, said magazine retaining means being operable to release said magazine from said receiver in response to operation of said grip assembly when said first member is connected to said second member by said coupling means.

2. A firearm comprising barrel having a bore extending axially therethrough, means supporting said barrel for axial reciprocal forward and rearward movement, a generally cylindrical rotary magazine drum having front and rear walls and defining a circumaxial series of firing chambers and a circumaxial series of sets of cam recesses equal in number to said firing chambers each of said cam recesses opening outwardly through the peripheral surface of said drum and having generally angularly opposed wall surfaces defining a cam track, each of said sets of cam recesses including a front cam recess opening outwardly through said front wall and a rear cam surface independent of said front cam recess and opening outwardly through said rear wall, means supporting said magazine drum rearward of said barrel for indexible rotation about its axis, and means for indexing said magazine drum about its axis to sequentially position each one of said firing chambers in a firing position wherein it is coaxially aligned with and defines a rearward extension of said bore and including a front indexing cam for engaging the cam track of an associated front cam recess during rearward movement of said barrel and a rear indexing cam for engaging the cam track of an associated rear cam recess during forward movement of said barrel, and means for moving said indexing cams in unison in response to said movement of said barrel.

3. A firearm as set forth in claim 2 wherein each one of said cam recess has one cam track defining wall surface which extends from the outer end to the inner end of said one cam recess and in a direction generally parallel to the axis of said magazine drum and said one cam recess has a minimum angular width at its inner end and a maximum angular width at its outer end.

4. A firearm as set forth in claim 2 wherein said cam track of said front cam recess has a first portion extending in a direction generally parallel to the axis of said magazine drum, a second portion exending in a direction parallel to said axis and spaced in one angular direction from said first portion, and a third portion extending from the forward end of said second portion toward said front wall and in said one angular direction away from said second portion and said cam track of said rear cam recess has a fourth portion extending in a direction parallel to said axis and a fifth portion extending toward said rear wall and in said one angular direction away from said fourth portion.

5. A firearm as set forth in claim 2 wherein said means for moving said indexing cams comprises a rod attached to said barrel and said front indexing cam and said rear indexing cam are supported in fixed position on said rod.

6. A firearm as set forth in claim 2 having firing means for firing a shell disposed with said firing chamber in said firing position and including a firing element movable between cocked and released positions, means biasing said firing element toward its released position, and a trigger operable to release said firing element from its cocked position and wherein said means for moving said indexing cams comprises means for moving said firing element to its cocked position.

7. A firearm as set forth in claim 6 wherein said means for moving said indexing cams comprises a rod connected to said barrel and engageable with said firing means rearward of said magazine.

8. A firearm as set forth in claim 7 wherein said indexing cams are mounted in fixed position on said rod.

9. A firearm as set forth in claim 6 having manually operable means for moving said firing element to said cocked position including a reciprocally movable grip assembly operable to move said barrel in one direction, said barrel being movable independently of said grip assembly.

10. A firearm as set forth in claim 6 including auxiliary means for moving said firing element to its cocked position independent of the movement of said barrel.

11. A firearm as set forth in claim 2 wherein each of said firing chambers includes a main portion, another portion forward of said main portion and having a diameter smaller than the diameter of said main portion, and a generally conically tapered transitional portion converging from said main portion to said other portion.

12. A firearm as set forth in claim 2 wherein said magazine drum supporting means comprises a downwardly open magazine drum receiver and includes magazine drum retaining means for releasably securing said magazine drum to said receiver and said firearm includes manually operable means for releasing said magazine drum retaining means to allow said magazine drum to fall freely from said receiver.

13. A firearm as set forth in claim 12 wherein said manually operable means for releasing said magazine comprises a manually movable grip assembly for cocking said firearm, a trigger, and means for coupling said grip assembly to said magazine retaining means in response to the operation of said trigger.

14. A firearm comprising a receiver, a barrel supported by said receiver and having a generally cylindrical bore, a rotary magazine supported for indexible rotation on said receiver and having a circumaxial series of firing chambers, magazine retaining means for releasably securing said magazine to said receiver, means for indexing said magazine about its axis of rotation to sequentially locate each one of said firing chambers in a firing position wherein said one firing chamber is coaxially aligned with said bore, firing means for exploding a shell disposed within said one firing chamber and including manual operating means for cocking said firing means and a firing trigger movable from an inactive position to a firing position to release said firing means from its cocked position, and coupling means for releasably connecting said magazine retaining means to said manual operating means in response to movement of said firing trigger to a predetermined position, said magazine retaining means being operable to release said magazine from said receiver in response to operation of said manual operating means when said magazine retaining means is connected to said manual operating means by said coupling means.

15. A firearm as set forth in claim 14 wherein said magazine retaining means comprises means for supporting said magazine for rotation about said axis of rotation.

16. A firearm as set forth in claim 14 wherein manual operating means comprises a grip assembly supported for reciprocal movement relative to said receiver and said coupling means comprises means for coupling said magazine supporting means to said grip assembly.

17. A firearm as set forth in claim 16 wherein said grip assembly includes a first member, said magazine supporting means includes a second member coaxially disposed within said magazine, and said coupling means comprises means for coupling said first member to said second member.

18. A firearm as set forth in claim 17 wherein said coupling means comprises said firing trigger.

19. A firearm as set forth in claim 17 wherein said first and second members comprise telescopically engaged members.

20. A firearm as set forth in claim 16 wherein said grip assembly is movable in one direction and to a magazine releasing position to release said magazine from said receiver and said firearm includes means for biasing said grip assembly in a direction opposite said one direction.

21. A firearm as set forth in claim 20 including means for releasably securing said grip assembly in said magazine releasing position.

22. A firearm as set forth in claim 21 wherein said means for releasably securing said grip assembly comprises a locking trigger movable between locking and releasing position, said locking trigger in said locking position releasably securing said grip assembly in said magazine releasing position.

23. A firearm as set forth in claim 22 wherein said locking trigger is supported in opposing relation to said firing trigger.

24. A firearm comprising a barrel having a bore extending axially therethrough, means supporting said barrel for axial reciprocal forward and rearward movement, a rotary magazine having a circumaxial series of generally cylindrical firing chambers, means supporting said magazine rearward of said barrel for indexible rotation about its axis, means for indexing said magazine about its axis to sequentially position each one of said firing chambers in a firing position wherein it is coaxially aligned with and defines a rearward extension of said bore and including a circumaxial series of sets of cam tracks on said magazine, means for firing a shell disposed with said firing chamber in said firing position and including a firing element movable between cocked and released positions, means biasing said firing element toward its released position, and a trigger operable to release said firing element from its cocked position, means for moving said indexing cams and for moving said firing element to its cocked position in response to said movement of said barrel including a rod connected to said barrel and engageable with said firing means rearward of said magazine and a plurality of indexing cams mounted in fixed position on said rod for engaging said cam tracks, and manually operable means for moving said firing element to said cocked position including a reciprocally movable grip assembly operable to move said barrel in one direction, said barrel being movable independenty of said grip assembly.

* * * * *